US008246751B2

(12) United States Patent
Zhang et al.

(10) Patent No.: US 8,246,751 B2
(45) Date of Patent: Aug. 21, 2012

(54) PULSED DETONATION CLEANING SYSTEMS AND METHODS

(75) Inventors: Tian Xuan Zhang, Raytown, MO (US); David Michael Chapin, Raytown, MO (US)

(73) Assignee: General Electric Company, Schenectady, NY (US)

( * ) Notice: Subject to any disclaimer, the term of this patent is extended or adjusted under 35 U.S.C. 154(b) by 82 days.

(21) Appl. No.: 12/895,920

(22) Filed: Oct. 1, 2010

(65) Prior Publication Data

US 2012/0080055 A1 Apr. 5, 2012

(51) Int. Cl.
*B08B 5/00* (2006.01)
*F23C 15/00* (2006.01)

(52) U.S. Cl. ..... 134/1; 134/19; 134/184; 122/24; 122/379; 431/1; 431/2; 431/3

(58) Field of Classification Search ..... 134/1, 19, 134/20, 22.1, 22.11, 22.12, 22.18, 34, 37, 134/94.1, 102.1, 166 R, 167 C; 431/1, 2, 431/3; 122/379, 396, 24
See application file for complete search history.

(56) References Cited

U.S. PATENT DOCUMENTS

| | | | |
|---|---|---|---|
| 1,547,440 | A | 7/1925 | Penn |
| 1,553,813 | A | 9/1925 | Griffin |
| 1,588,772 | A | 6/1926 | Rorabeck |
| 1,597,850 | A | 8/1926 | Weis |
| 1,598,771 | A | 9/1926 | Gerhardt |
| 1,602,838 | A | 10/1926 | Rhomberg |
| 1,634,094 | A | 6/1927 | Cook et al. |
| 1,668,438 | A | 5/1928 | Weis |
| 1,704,364 | A | 3/1929 | Markley |
| 1,715,442 | A | 6/1929 | Weis |
| 2,165,120 | A | 7/1939 | Ammendola |
| 2,193,999 | A | 3/1940 | Allen |
| 2,328,865 | A | 9/1943 | Urquhart |
| 2,352,019 | A | 6/1944 | Schott |
| 2,559,757 | A | 7/1951 | Chandler |
| 2,637,865 | A | 5/1953 | Posson |
| 2,674,760 | A | 4/1954 | Finch |
| 2,882,539 | A | 4/1959 | Walz |
| 2,911,665 | A | 11/1959 | Mackiewicz et al. |
| 3,400,419 | A | 9/1968 | Fuller |
| 3,490,468 | A | 1/1970 | Di Donato |
| 3,531,813 | A | 10/1970 | Hurst |
| 3,622,279 | A | 11/1971 | Moran |
| 3,631,555 | A | 1/1972 | Hurst et al. |
| 3,712,029 | A | 1/1973 | Charlton |
| 3,771,187 | A | 11/1973 | Dillinger |
| 3,778,858 | A | 12/1973 | Fuller |
| 3,794,051 | A | 2/1974 | Lee, Jr. et al. |

(Continued)

OTHER PUBLICATIONS

Pending U.S. Appl. No. 12/813,735, filed Jun. 11, 2010, Zhang, et al.

(Continued)

*Primary Examiner* — Saeed T Chaudhry
(74) *Attorney, Agent, or Firm* — Sutherland Asbill & Brennan LLP

(57) ABSTRACT

The present application provides a pulsed detonation cleaning system for cleaning an enclosed structure. The pulsed detonation cleaning system may include a pulsed detonation combustor cleaner and an external fuel-air flow. The pulsed detonation combustor cleaner delivers the external fuel-air flow into the enclosed structure and ignites the external fuel-air flow to clean the enclosed structure.

16 Claims, 3 Drawing Sheets

U.S. PATENT DOCUMENTS 3,817,262 A 6/1974 Caradeur et al.
3,859,065 A 1/1975 Schoeck
3,901,252 A 8/1975 Riebe
3,903,912 A 9/1975 Ice, Jr. et al.
3,916,469 A 11/1975 Anthem et al.
3,921,905 A 11/1975 McElhoe et al.
3,938,535 A 2/1976 Cradeur et al.
3,939,519 A 2/1976 Muirhead
4,011,625 A 3/1977 Goodwin
4,031,915 A 6/1977 McElhoe et al.
4,032,072 A 6/1977 McElhoe et al.
4,053,282 A 10/1977 Hach et al.
4,058,870 A 11/1977 Goodwin
4,059,959 A 11/1977 Matthews
4,073,026 A 2/1978 Goodwin
4,106,576 A 8/1978 Clements
4,122,575 A 10/1978 Sagawa
4,124,065 A 11/1978 Leitner et al.
4,177,765 A 12/1979 Wehrmeister
4,178,649 A 12/1979 Kouse et al.
4,181,998 A 1/1980 Nelson
4,244,072 A 1/1981 Dunham et al.
4,264,912 A 4/1981 Coburn et al.
4,267,964 A 5/1981 Williams
4,279,624 A 7/1981 Wilson
4,280,852 A 7/1981 Dunham et al.
4,281,432 A 8/1981 Saxon
4,296,800 A 10/1981 Johnson
4,353,414 A 10/1982 Leitner
4,367,790 A 1/1983 Braeger
4,372,937 A 2/1983 Johnson
4,382,465 A 5/1983 Baron et al.
4,383,346 A 5/1983 Bochinski et al.
4,397,349 A 8/1983 Baron et al.
4,398,592 A 8/1983 Baron et al.
4,406,031 A 9/1983 Eimer et al.
4,476,917 A 10/1984 Otake et al.
4,489,776 A 12/1984 Baron
4,508,164 A 4/1985 Baron
4,544,026 A 10/1985 Baron
4,552,207 A 11/1985 Baron et al.
4,561,495 A 12/1985 Baron
4,562,886 A 1/1986 Holm
4,583,586 A 4/1986 Fujimoto et al.
4,592,417 A 6/1986 Baron
4,595,049 A 6/1986 Baron et al.
4,595,050 A 6/1986 Baron
4,605,028 A 8/1986 Paseman
4,607,686 A 8/1986 Baron et al.
4,617,987 A 10/1986 Fujimoto et al.
4,627,486 A 12/1986 Baron
4,643,248 A 2/1987 Voith et al.
4,667,732 A 5/1987 Harding et al.
4,696,318 A 9/1987 Smith
D292,309 S 10/1987 Baron
4,781,245 A 11/1988 Freychet et al.
4,805,653 A 2/1989 Krajicek et al.
4,846,895 A 7/1989 Rabe
4,856,545 A 8/1989 Krajicek et al.
4,914,776 A 4/1990 Kaye
4,966,177 A 10/1990 John, Jr. et al.
5,002,120 A 3/1991 Boisture et al.
5,022,463 A 6/1991 Boisture
5,031,691 A 7/1991 Boisture
5,058,440 A 10/1991 Graze, Jr.
5,067,558 A 11/1991 Boisture
5,129,455 A 7/1992 Boisture
5,153,963 A 10/1992 Saxon et al.
5,170,524 A 12/1992 Vowles
5,207,578 A 5/1993 Sakata
5,235,718 A 8/1993 Grimsley et al.
5,288,662 A 2/1994 Lagendijk et al.
5,298,075 A 3/1994 Lagendijk et al.
5,305,488 A 4/1994 Lyle
D353,715 S 12/1994 Willinger
5,426,807 A 6/1995 Grimsley et al.
5,433,229 A 7/1995 Blair
5,453,470 A 9/1995 Kasai et al.
5,473,787 A 12/1995 Echols
5,474,097 A 12/1995 Lowe et al.
5,493,748 A 2/1996 Santo
5,636,403 A 6/1997 Grimsley et al.
5,678,584 A 10/1997 O'Brien
5,709,691 A 1/1998 Morejon
5,799,622 A 9/1998 Waldner
5,871,589 A 2/1999 Hedge
5,883,512 A 3/1999 Streit et al.
5,884,468 A 3/1999 Reuters
5,890,531 A 4/1999 Gairns et al.
5,966,768 A 10/1999 Hahn
5,972,125 A 10/1999 Hedge
6,014,789 A 1/2000 Knapp
6,067,999 A 5/2000 Hines et al.
6,082,361 A 7/2000 Morejon
6,085,376 A 7/2000 Antal et al.
6,088,866 A 7/2000 Hedge
6,116,333 A 9/2000 Diem et al.
6,170,493 B1 1/2001 Sivacoe
6,227,297 B1 5/2001 Milam
6,279,213 B1 8/2001 Kohlen et al.
6,283,028 B1 9/2001 Walczak
6,303,087 B1 10/2001 Wedekamp
6,318,368 B1 11/2001 Morejon
6,390,105 B1 5/2002 Ramsey
6,391,121 B1 5/2002 Sivacoe
6,473,481 B1 10/2002 Ishii et al.
6,494,208 B1 12/2002 Morejon
6,569,255 B2 5/2003 Sivacoe
6,609,531 B2 8/2003 Lesko
6,620,966 B2 9/2003 Ohkoshi et al.
6,626,195 B1 9/2003 Garman et al.
6,672,794 B2 1/2004 Reichborn
6,679,262 B1 1/2004 Morejon
6,681,839 B1 1/2004 Balzer
D489,495 S 5/2004 Franzino
6,736,722 B1 5/2004 Pope
6,855,045 B2 2/2005 Laws
6,909,816 B2 6/2005 Kychakoff et al.
7,011,047 B2 3/2006 Aarnio et al.
D518,607 S 4/2006 Franzino
D521,241 S 5/2006 Dimmerling
7,040,331 B2 5/2006 Garman et al.
7,047,908 B2 5/2006 Henderson
7,051,737 B2 5/2006 Kolobow et al.
7,055,203 B1 6/2006 Franzino
7,055,278 B1 6/2006 Davis
7,060,135 B2 6/2006 Morejon
7,104,223 B2 9/2006 Bussing
7,131,229 B1 11/2006 Davis
7,162,981 B2 1/2007 Hernandez
7,178,534 B2 2/2007 Garman et al.
D545,008 S 6/2007 Franzino
7,231,930 B1 6/2007 Stedam
7,267,134 B2 9/2007 Hochstein, Jr. et al.
D554,374 S 11/2007 Franzino
D555,847 S 11/2007 Franzino
D561,412 S 2/2008 Franzino
7,437,025 B2 10/2008 Kychakoff et al.
7,442,034 B2 10/2008 Chenevert et al.
7,454,812 B1 11/2008 Lyle
7,520,287 B2 4/2009 Kozy et al.
7,530,363 B2 5/2009 Garman
7,666,263 B2 2/2010 Walters
7,669,600 B2 3/2010 Morejon
7,698,769 B2 4/2010 Walters
2001/0042277 A1 11/2001 Reichborn
2002/0101954 A1 8/2002 Ishii et al.
2002/0171706 A1 11/2002 Miyamoto et al.
2003/0021461 A1 1/2003 Kychakoff et al.
2003/0056816 A1 3/2003 Lesko
2003/0209258 A1 11/2003 Morejon
2004/0060130 A1 4/2004 Garman et al.
2004/0069331 A1 4/2004 Garman et al.
2004/0110551 A1 6/2004 Pope
2004/0142648 A1 7/2004 Laws
2004/0181194 A1 9/2004 Perkins
2005/0109231 A1* 5/2005 Bussing ..... 102/302

2005/0112516 A1* 5/2005 Aarnio et al. ..... 431/1
2005/0125930 A1 6/2005 Flatness et al.
2005/0125931 A1 6/2005 Chenevert et al.
2005/0125932 A1 6/2005 Kendrick
2005/0125933 A1 6/2005 Hochstein, Jr. et al.
2005/0126511 A1 6/2005 Henderson
2005/0126512 A1 6/2005 Kendrick et al.
2005/0126594 A1 6/2005 Chenevert et al.
2005/0126595 A1 6/2005 Flatness et al.
2005/0130084 A1 6/2005 Aarnio et al.
2005/0138753 A1 6/2005 Hufnagel
2005/0172971 A1 8/2005 Kolobow et al.
2005/0199743 A1* 9/2005 Hochstein et al. ..... 239/67
2005/0220331 A1 10/2005 Kychakoff et al.
2006/0027250 A1 2/2006 Walters
2006/0130847 A1 6/2006 Morejon
2006/0169302 A1 8/2006 Kozy et al.
2006/0179588 A1 8/2006 Walters
2006/0185623 A1 8/2006 Aarnio et al.
2006/0207525 A1 9/2006 Hernandez
2006/0249185 A1 11/2006 Garman
2007/0074744 A1 4/2007 Kozy et al.
2007/0119007 A1 5/2007 Minshall
2008/0092828 A1 4/2008 Flatness et al.
2008/0264357 A1 10/2008 Liljegren et al.
2008/0271270 A1 11/2008 Sawada et al.
2008/0271685 A1 11/2008 Lupkes et al.
2008/0292998 A1* 11/2008 Hochstein et al. ..... 431/1
2009/0101175 A1 4/2009 Honkanen et al.
2009/0165827 A1 7/2009 Kozy et al.
2009/0178681 A1 7/2009 Bracken
2009/0188648 A1 7/2009 Tao
2009/0229068 A1 9/2009 Henderson et al.
2009/0242002 A1 10/2009 Garman
2009/0255557 A1 10/2009 Gardner et al.
2009/0277479 A1 11/2009 Lupkes
2009/0294100 A1 12/2009 Ho

OTHER PUBLICATIONS

Pending U.S. Appl. No. 12/639,560, filed Dec. 16, 2009, Chapin, et al.

* cited by examiner

PULSED DETONATION CLEANING SYSTEMS AND METHODS

TECHNICAL FIELD

The present application relates generally to pulsed detonation cleaning systems and methods and more particularly relates to pulsed detonation cleaning systems and methods using the combustion of an external fuel-air mixture for cleaning tubes and other types of enclosed surfaces.

BACKGROUND OF THE INVENTION

Industrial boilers operate by using a heat source to create steam from water or another type of a working fluid. The steam may be used to drive a turbine or other type of load. The heat source may be a combustor that burns a fuel-air mixture therein. Heat may be transferred to the working fluid from the combustor via a heat exchanger. Burning the fuel-air mixture, however, may generate residues on the surface of the combustor, heat exchangers, and the like. Further, the working fluid flowing through the tubes of the heat exchangers and other types of enclosures also may develop residues and other deposits therein. The presence of these residues and other deposits may inhibit the efficient transfer of heat to the working fluid. This reduction in efficiency may be reflected by an increase in the exhaust gas temperature from the backend of the process as well as an increase in the fuel burn rate required to maintain steam production and energy output. Periodic removal of the residues and deposits thus may help maintain the overall system efficiency. Typically, the complete removal of the deposits generally requires the boiler or other system to be shut down while the cleaning process is performed.

Pressurized steam, water jets, acoustic waves, mechanical hammering, and other methods having been used to remove these internal deposits while offline. For example, mechanical methods may include different kinds of brushes, headers, and lances to mechanically pass through the tube. Chemical methods may include the use of different kinds of chemical solutions. Pneumatic/hydraulic methods may use compressed air or high pressure water jets. Vacuum methods also may be used. Finally, combinations of these methods also are known.

More recently, detonative combustion devices have been employed. Specifically, a pulsed detonation combustor external to the boiler, heat exchanger tubes, or other system may be used to generate a series of detonations or quasi-detonations that may be directed therein. The high speed shockwaves travel through the boiler, the tubes, or otherwise and loosen the deposits from the surfaces therein. The pulsed detonation combustor systems result in quick cleaning, however, tend to require a large footprint. Moreover, the strength/effectiveness of the shockwave decreases as it travels away from the detonation combustor such that there is a limit to the cleaning range.

There is thus a desire for cleaning systems and methods that are able to operate quickly to remove internal deposits in boilers, heat exchanger tubes, and the like so as to minimize downtime. It is further desirable that the systems and methods may operate within the existing environment, i.e., that the system is able to fit physically within the existing space restrictions while being able to reach all of the tubes or other surfaces that require cleaning with the most intense pressure wave throughout the vessel.

SUMMARY OF THE INVENTION

The present application thus provides a pulsed detonation cleaning system for cleaning an enclosed structure. The pulsed detonation cleaning system may include a pulsed detonation combustor cleaner and an external fuel-air flow. The pulsed detonation combustor cleaner delivers the external fuel-air flow into the enclosed structure and ignites the external fuel-air flow to clean the enclosed structure.

The present application further provides a method of cleaning an enclosed structure with a pulsed detonation combustor cleaner. The method may include the steps of positioning the pulsed detonation combustor cleaner about an inlet of the enclosed structure, flowing an external fuel-air mixture into the enclosed structure from the pulsed detonation combustor cleaner, and igniting the external fuel-air mixture to clean the enclosed structure.

The present application further provides a pulsed detonation cleaning system for cleaning a tube. The pulsed detonation cleaning system may include a pulsed detonation combustor cleaner with a combustion chamber, a flow of air in communication with the combustion chamber, and a flow of gas in communication with the combustion chamber. The flow of air and the flow of gas mix in the combustion chamber to form an external fuel-air flow such that the pulsed detonation combustor cleaner delivers the external fuel-air flow into the tube and ignites the external fuel-air flow to clean the tube.

These and other features and improvements of the present application will become apparent to one of ordinary skill in the art upon review of the following detailed description when taken in conjunction with the several drawings and the appended claims.

DETAILED DESCRIPTION

As used herein, the term "pulsed detonation combustor" ("PDC") refers to a device or a system that produces both a pressure rise and a velocity increase from the detonation or quasi-detonation of a fuel and an oxidizer. The PDC may be operated in a repeating mode to produce multiple detonations or quasi-detonations within the device. A "detonation" may be a supersonic combustion in which a shock wave is coupled to a combustion zone. The shock may be sustained by the energy release from the combustion zone so as to result in combustion products at a higher pressure than the combustion reactants. A "quasi-detonation" may be a supersonic turbulent combustion process that produces a pressure rise and a velocity increase higher than the pressure rise and the velocity increase produced by a sub-sonic deflagration wave. For simplicity, the terms "detonation" or "detonation wave" as used herein will include both detonations and quasi-detonations.

Exemplary PDC's, some of which will be discussed in further detail below, include an ignition device for igniting a combustion of a fuel/oxidizer mixture and a detonation chamber in which pressure wave fronts initiated by the combustion coalesce to produce a detonation wave. Each detonation or quasi-detonation may be initiated either by an external ignition source, such as a spark discharge, laser pulse, heat source, or plasma igniter, or by gas dynamic processes such as shock focusing, auto-ignition, or an existing detonation wave from another source (cross-fire ignition). The detonation chamber geometry may allow the pressure increase behind the detonation wave to drive the detonation wave and also to blow the combustion products themselves out an exhaust of the PDC.

Various chamber geometries may support detonation formation, including round chambers, tubes, resonating cavities, reflection regions, and annular chambers. Such chamber designs may be of constant or varying cross-section, both in area and shape. Exemplary chambers include cylindrical tubes and tubes having polygonal cross-sections, such as, for example, hexagonal tubes. As used herein, "downstream" refers to a direction of flow of at least one of the fuel or the oxidizer.

Figure 1:
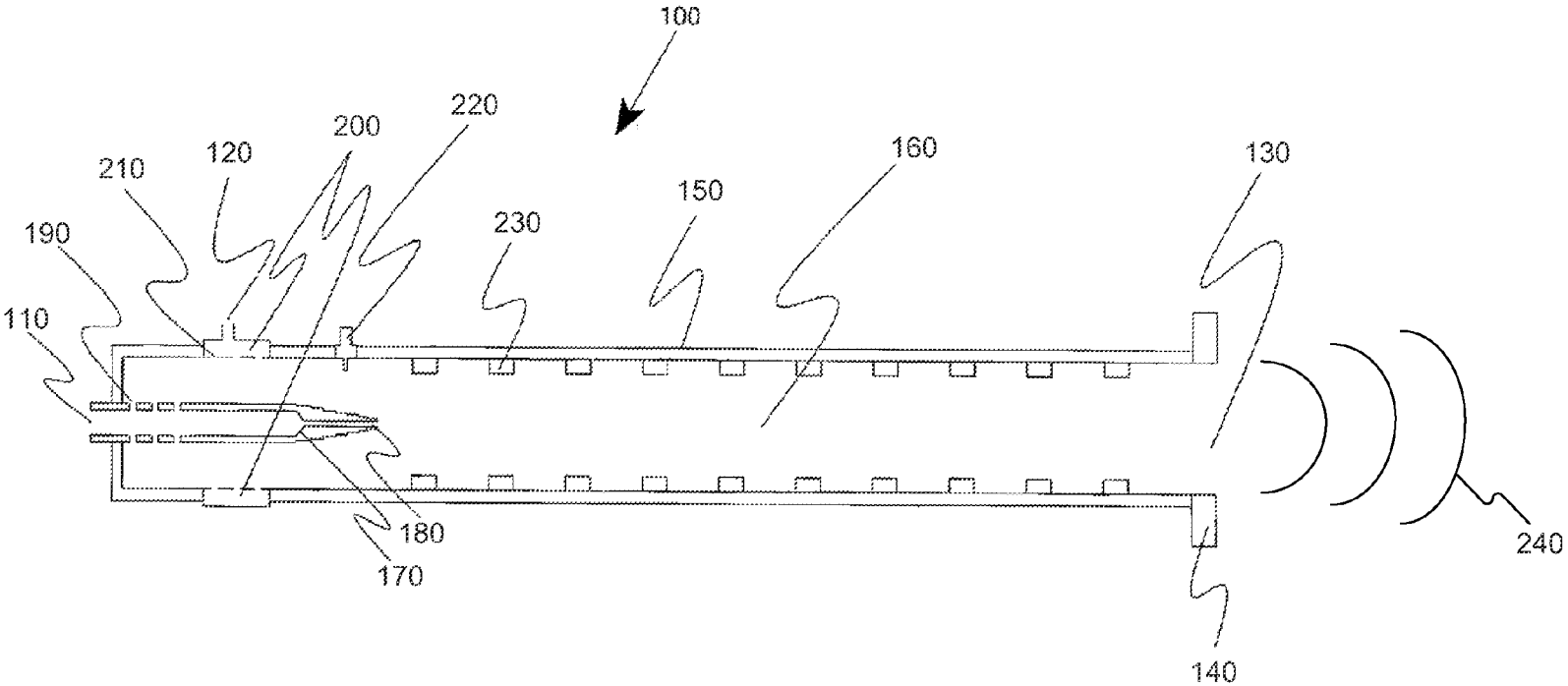
FIG. 1 is a schematic view of a known pulsed detonation combustor cleaner.

Referring now to the drawings, in which like numbers refer to like elements throughout the several views, FIG. 1 shows an example of a pulsed detonation combustor cleaner 100. The PDC cleaner 100 may extend along the illustrated x-axis from an upstream head end that includes an air inlet 110 and a fuel inlet 120 to an exit aperture 130 at a downstream end. The aperture 130 of the PDC cleaner 100 may be attached to a wall 140 of a boiler, a heat exchanger, or other structure to be cleaned. A tube 150 may extend from the head end to the aperture 130 so as to define a combustion chamber 160 therein. The air inlet 110 may be connected to a source of pressurized air. The pressurized air may be used to fill and purge the combustion chamber 160 and also may serve as an oxidizer for the combustion of the fuel.

The air inlet 110 may be connected to a center body 170 that may extend along the axis of the tube 150 and into the combustion chamber 160. The center body 170 may be in the form of a generally cylindrical tube that extends from the air inlet 102 and tapers to a downstream opening 180. The center body 170 also may include one or more air holes 190 along its length. The air holes 190 may allow the air flowing through the center body 170 to enter into the upstream end of the chamber 160. The opening 180 and the air holes 190 of the center body 170 may allow for directional velocity to be imparted to the air that is fed into the tube 150 through the air inlet 110. Such a directional flow may be used to enhance the turbulence in the injected air and also to improve the mixing of the air with the fuel present within the flow in the head end of the tube 150.

The air holes 190 may be disposed at multiple angular and axial locations about the axis of the center body 170. The angle of the air holes 190 may be purely radial to the axis of the center body 170. In other examples, the air holes 190 may be angled in the axial and circumferential directions so as to impart a downstream or rotational velocity to the flow from the center body 170. The flow through the center body 170 also may serve to provide cooling to the center body 170 so as to prevent an excessive heat buildup that could result in degradation therein.

The fuel inlet 120 may be connected to a supply of fuel that may be burned within the combustion chamber 160. A fuel plenum 200 may be connected to the fuel inlet 120. The fuel plenum 200 may be a cavity that extends around the circumference of the head end of the tube 150. A number of fuel holes 210 may connect the interior of the fuel plenum 200 with the interior of the tube 150. The fuel holes 210 may extend radially from the fuel plenum 200 and into the annular space between the wall of the tube 150 and the center body 170. As with the air holes 190, the fuel holes 210 may be disposed at a variety of axial and circumferential positions. In addition, the fuel holes 210 may be aligned to extend in a purely radial direction or may be canted axially or circumferentially with respect to the radial direction.

The fuel may be injected into the chamber 160 so as to mix with the air flow coming through the air holes 190 of the center body 170. The mixing of the fuel and the air may be enhanced by the relative arrangement of the air holes 190 and the fuel holes 210. For example, by placing the fuel holes 210 at a location such that fuel is injected into regions of high turbulence generated by the flow through the air holes 190, the fuel and the air may be more rapidly mixed so as to produce a more readily combustible fuel/air mixture. Fuel may be supplied to the fuel plenum 200 through the fuel inlet 120 via a valve that allows for the active control of the flow of fuel therethrough.

An ignition device 220 may be disposed near the head end of the tube 150. The ignition device 220 may be located along the wall of the tube 150 at a similar axial position to the end of the center body 170. This position allows for the fuel and the air coming through holes 190, 210 respectively to mix prior to flowing past the ignition device 220. The ignition device 220 may be connected to a controller so as to operate the ignition device 220 at desired times as well as providing feedback signals to monitor operations.

The tube 150 also may contain a number of obstacles 230 disposed at various locations along the length thereof. The obstacles 230 may take the form of ribs, indents, pins, or any structure. The obstacles 230 may be uniform or random in size, shape, or position. The obstacles 230 may be used to enhance the combustion as it progresses along the length of the tube 150 and to accelerate the combustion front into a detonation wave 240 before the combustion front reaches the aperture 130. The obstacles 230 shown herein may be thermally integrated with the wall of the tube 150. The obstacles 230 may include features that are machined into the wall, formed integrally with the wall (by casting or forging, for example), or attached to the wall, for example by welding. Other types of manufacturing techniques may be used herein.

Air thus enters through the air inlet 110 and passes through the downstream opening 180 and the air holes 190 of the center body 170. Likewise, fuel flows through the fuel inlets 120 and through the gas holes 210 of the fuel plenum 200. The fuel and the air are then ignited by the ignition device 220 into a combustion flow and the resultant detonation waves 240. The detonation waves 240 may extend along the length of the inner tube 270. Turbulence may be provided by the obstacles 230 therein. The detonation waves 240 then may exit via the exit aperture 130 such that the detonation waves 240 may be used for cleaning purposes in a boiler, a heat exchanger, and the like. Other configurations may be used herein.

The tube 150, the obstacles 230, the center body 170, and the other elements herein may be fabricated using a variety of materials suitable for withstanding the temperatures and pressures associated with repeated detonations. Such materials may include, but are not limited to, Inconel, stainless steel, aluminum, carbon steel, and the like. Other materials may be used herein.

Figure 2:
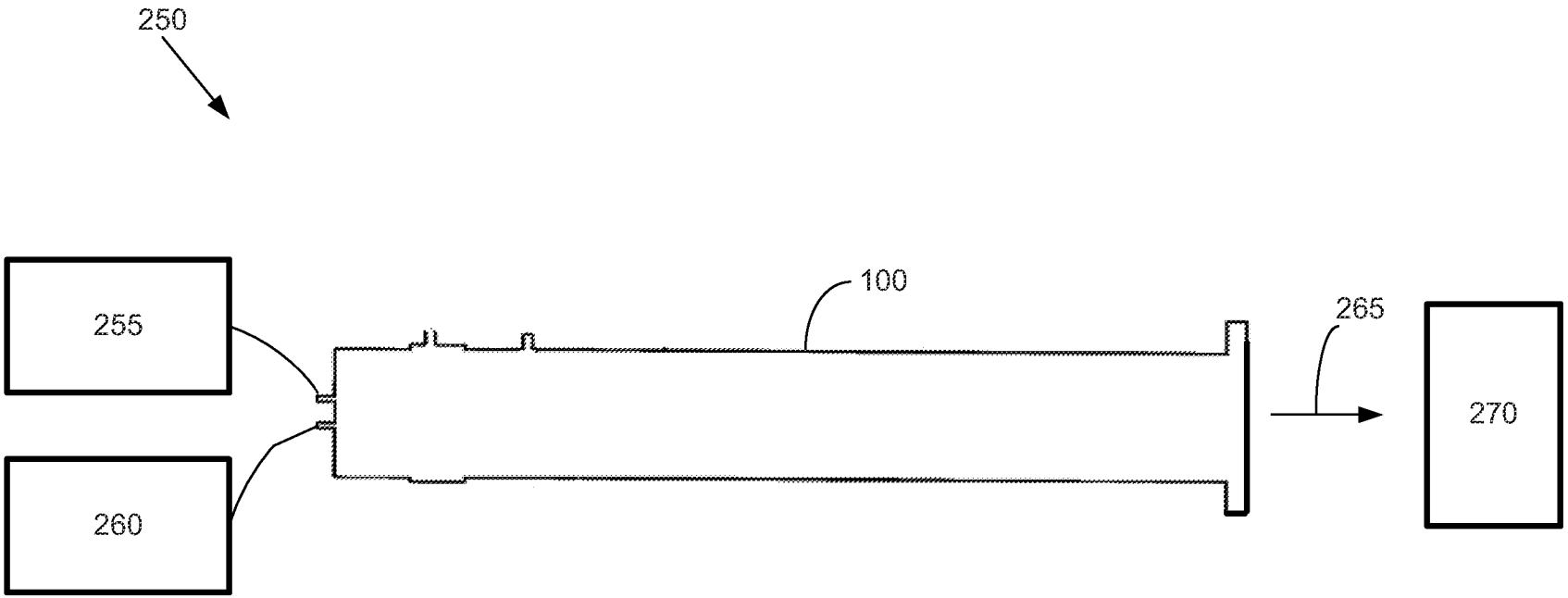
FIG. 2 is a schematic view of a pulsed detonation cleaning system as may be described herein.

FIG. 2 shows an example of a pulsed detonation cleaning system 250 as may be described herein. The pulsed detonation cleaning system 250 may include the PDC cleaner 100 or a similar type of pulsed detonation device. The pulsed detonation cleaning system 250 may be in communication with a flow of air 255 and a flow of fuel 260 in a manner similar to that described above. The PDC cleaner 100 of the pulsed detonation cleaning system 250 also may produce an external fuel-air flow 265 as will be described in more detail below to clean any type of enclosed surface 270.

Figure 3:
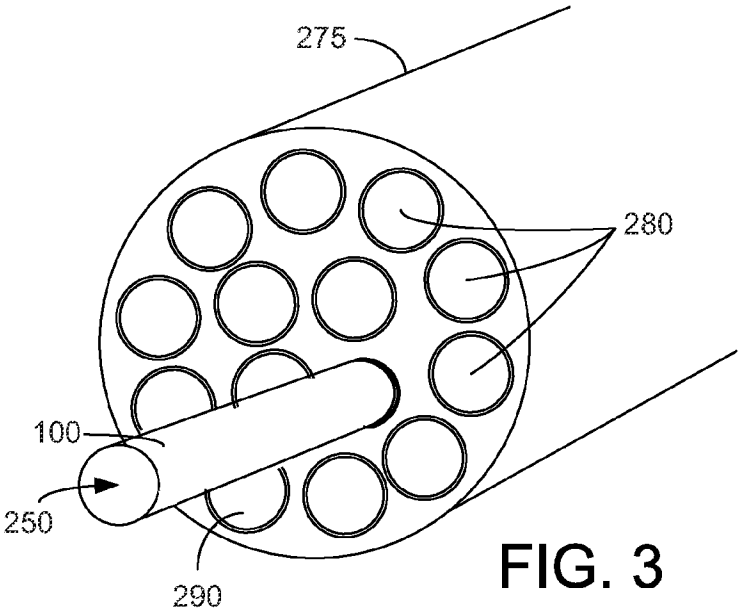
FIG. 3 is a perspective view of the pulsed detonation cleaning system of FIG. 2 used in a multi-tube heat exchanger.

For example, FIG. 3 shows the pulsed detonation cleaning system 250 used with an example of a heat exchanger 275 as the enclosed surface 270. Specifically, the pulse detonation cleaning system 250 may be used with a tube 280 within the overall heat exchanger 270. Other configurations may be used herein.

In use, the PDC cleaner 100 may be positioned about an inlet 290 of the tube 280 of the heat exchanger 270 or other type of structure. The flow of air 255 may enter through the air inlet 110 and pass through the downstream opening 180 and the air holes 190 of the center body 170 of the PDC cleaner 100. Likewise, the flow of fuel 260 may flow through the fuel inlets 120 and the gas holes 210 of the fuel plenum 200. Instead of being immediately ignited by the ignition device 220, the flow of air 255 and the flow of fuel 260 may mix within the combustion chamber 160 and form the external fuel-air flow 265. The external fuel-air flow 265 may pass out of the PDC cleaner 100 and into the inlet 290 of the tube 280. The external fuel-air flow 265 thus may fill the tube 280. The ignition device 220 then may ignite the external fuel-air flow 265 so as to create the detonation waves 240 within the combustion chamber 160 and through out the length of the tube 280. The detonation waves 240 may propagate at supersonic speeds therethrough and generate high local pressure within the tube 280. This high local pressure may serve to clean the residue and other deposits inside of the tube 280. This process then may be repeated for any or all of the other tube 280 within the heat exchanger 275.

Figure 4:
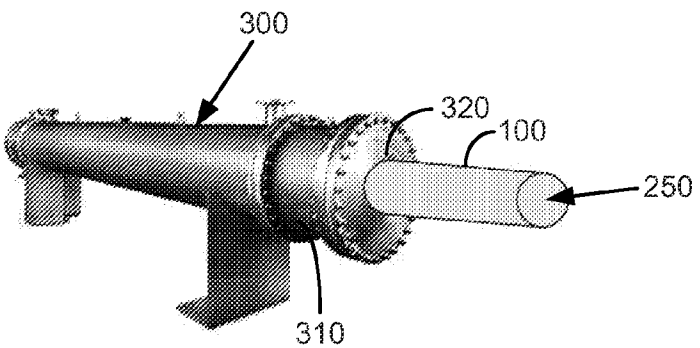
FIG. 4 is a perspective view of the pulsed detonation cleaning system of FIG. 2 used in a multi-tube heat exchanger with a header.

FIG. 4 shows a further embodiment of a heat exchanger 300. In this embodiment, the heat exchanger 300 also includes a number of the tube 280 therein. The heat exchanger 300 further includes a header 310. The header 310 may be in communication with each of the tubes 280. The header 310 may have a single inlet 320. Other configurations may be used herein.

As described above, the pulsed detonation cleaning system 250 may employ the PDC cleaner 100 and the external fuel-air flow 265 to clean the tubes 280 therein. Specifically, the PDC cleaner 100 may be positioned about the inlet 320 of the header 310. The PDC cleaner 100 may provide the fuel-air flow 265 to the inlet 320 of the header 310 such that the fuel-air flow 265 fills the header 310 and each of the tubes 280 of the heat exchanger 300. The ignition devices 220 then may ignite the external fuel-air flow 265 so as to create the detonation waves 240. As above, the detonation waves 240 may propagate through all of the tubes 280 at supersonic speeds and generate high local pressure. The high local pressure cleans each of the tubes 280 so as to remove the residue or other deposits therein.

Although the pulsed detonation cleaning system 250 has been described in terms of cleaning the tubes 280 of the heat exchangers 270, 300, the pulsed detonation cleaning system 250 may be used with any type of heat exchanger, boiler, pipeline, or other type of enclosed structure 270. The pulsed detonation cleaning system 250 thus generates a controlled supersonic wave to provide cleaning therein. Multiple pulsed detonation cleaning systems 250 may be used herein together. Likewise, the pulsed detonation cleaning system 250 may be used with other types of cleaning systems and the like.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A pulsed detonation cleaning system for cleaning an internal surface of a tube, the system comprising:
- a pulsed detonation combustor cleaner comprising:
  - a combustion chamber; and
  - an exit aperture disposed downstream of the combustion chamber;
- the exit aperture being positioned in abutting relationship to the tube;
- an external fuel-air mixture flow configured to pass through the exit aperture and into the tube; and
- wherein the pulsed detonation combustor cleaner delivers the external fuel-air mixture flow into the tube and ignites the external fuel-air mixture flow to create a plurality of detonation waves within the combustion chamber and throughout the tube to clean the internal surface of the tube.

2. The pulsed detonation cleaning system of claim 1, further comprising a flow of air and a flow of fuel in communication with the combustion chamber.

3. The pulsed detonation cleaning system of claim 2, wherein the combustion chamber mixes the flow of air and the flow of fuel therein.

4. The pulsed detonation cleaning system of claim 1, wherein the pulsed detonation combustor cleaner comprises an ignition device to ignite the external fuel-air flow.

5. The pulsed detonation cleaning system of claim 1, wherein the tube is part of a heat exchanger.

6. The pulsed detonation cleaning system of claim 1, wherein the tube is part of a heat exchanger with a header in communication with a plurality of tubes.

7. A method of cleaning an internal surface of a tube with a pulsed detonation combustor cleaner, comprising:
- positioning an exit aperture of the pulsed detonation combustor cleaner in abutting relation to an inlet of the tube;
- flowing an external fuel-air mixture into the tube from the pulsed detonation combustor cleaner; and
- igniting the external fuel-air mixture to create a plurality of detonation waves within the pulsed detonation combustion cleaner and throughout the tube to clean the internal surface of the tube.

8. The method of claim 7, further comprising the step of mixing a flow of fuel and a flow of air in a combustion chamber to create the external fuel-air flow.

9. The method of claim 7, wherein the step of flowing the external fuel-air flow into the tube from the pulsed detonation combustor cleaner comprises flowing the external fuel-air flow into a heat exchanger.

10. The method of claim 7, wherein the step of flowing the external fuel-air flow into the tube from the pulsed detonation combustor cleaner comprises flowing the external fuel-air flow into a heat exchanger with a header in communication with a plurality of tubes.

11. The method of claim 7, further comprising the step of creating high pressure from the plurality of detonation waves.

12. A pulsed detonation cleaning system for cleaning an internal surface of a tube, comprising:
- a pulsed detonation combustor cleaner comprising:
  - a combustion chamber;
  - an air inlet and a fuel inlet in communication with the combustion chamber configured to mix an air flow from the air inlet with a fuel flow from the fuel inlet; and
  - an exit aperture disposed downstream of the air inlet and the fuel inlet;
- the exit aperture being positioned in abutting relationship to the tube to form a single continuous combustion zone comprising both the combustion chamber and the tube;

wherein the flow of air and the flow of gas mix in the combustion chamber to form an external fuel-air flow such that the pulsed detonation combustor cleaner delivers the external fuel-air flow into the tube and ignites the external fuel-air flow to clean the internal surface of the tube.

13. The pulsed detonation cleaning system of claim 12, wherein the pulsed detonation combustor cleaner comprises an ignition device to ignite the external fuel-air flow.

14. The pulsed detonation cleaning system of claim 12, further comprising a plurality of detonation waves resulting from the ignition of the external fuel-air flow within the tube.

15. The pulsed detonation cleaning system of claim 12, wherein the tube comprises a heat exchanger.

16. The pulsed detonation cleaning system of claim 12, wherein the tube comprises a heat exchanger with a header in communication with a plurality of tubes.

* * * * *